US005522598A

United States Patent [19]

Loyd et al.

[11] Patent Number: 5,522,598

[45] Date of Patent: Jun. 4, 1996

[54] RICK-A-SHAY BALL TOSS GAME

[76] Inventors: Gloria D. Loyd; David W. Loyd, both of 514 South Valley, Cortez, Colo. 81321

[21] Appl. No.: 312,783

[22] Filed: Sep. 26, 1994

[51] Int. Cl.[6] ..... A63B 63/08

[52] U.S. Cl. ..... 273/402; 273/411

[58] Field of Search ..... 273/410, 394, 273/402, 404, 398, 401, 407, 408, 411

[56] References Cited

U.S. PATENT DOCUMENTS

| | | | |
|---|---|---|---|
| D. 318,883 | 8/1991 | Pazienza | D21/2 |
| 979,109 | 12/1910 | Underhill | 273/400 |
| 3,350,097 | 10/1967 | Chevrette et al. | 273/402 |
| 3,599,978 | 8/1971 | Sondergaard | 273/394 |
| 3,602,505 | 8/1971 | Friend | 273/400 |
| 3,643,950 | 2/1972 | Holk | 273/105 R |
| 4,617,812 | 9/1986 | Morrison | 273/400 |
| 5,257,808 | 11/1993 | Mueller et al. | 273/178 R |

FOREIGN PATENT DOCUMENTS

| | | | |
|---|---|---|---|
| 620800 | 8/1978 | U.S.S.R. | 273/394 |

*Primary Examiner*—Mark S. Graham

*Attorney, Agent, or Firm*—David L. Baker; Rhodes & Ascolillo

[57] ABSTRACT

A ball toss game that uses a vertical pole with a panel, resembling an inverted lamp shade mounted on the end. The panel has holes in each quadrant for releasing resilient balls bounced off the floor and at least one wall. Each player has two attempts to score for each turn. The number to turns and value of each score is determined by the players.

1 Claim, 2 Drawing Sheets

RICK-A-SHAY BALL TOSS GAME

BACKGROUND OF THE INVENTION

1 . Field of the Invention

This invention relates generally to ball games and more specifically to such games that involve tossing a ball into a target-scoring game apparatus.

2. Description of the Prior Art

People of all ages enjoy games that involve the manipulation, in one fashion or another, of a ball. Ball toss games are just one manifestation of the phenomena. In general, ball toss games require some space and are generally best suited for out of doors activity rather then in the living room. There are some games that can be played both inside and outside with a small amount of equipment and minimal endangerment to furniture and furnishings. For example in U.S. Pat. No. 3,643,950 issued Feb. 22, 1972 to Holk shows an indoor/ outdoor ball toss game using a box with openings on the front and target baskets with ducts to carry the balls to a separate compartment from which the players can calculate their scores. A U.S. Pat. No. Des. 318,883 was issued to Pazienza on Aug. 6, 1991 for a Game Ball Target that we are allowed to assume accepts game balls in the cups mounted on the front of the target and given points for each ball that is thrown into the cup. It reasonably appears that the game associated with the target could be played inside or outside. U.S. Pat. No. 5,257,808 issued Nov. 2, 1993 to Mueller et al. discloses a game ball target for golf. Although golf is a game played outside, the target allows certain aspects of the game to also be played indoors.

It is clearly seen and understood that a plethora of indoor and outdoor ball games exist and as long as there are people with a ball and some creative spirit new games will continue evolve.

SUMMARY OF THE INVENTION

The invention is directed to a ball toss game and an apparatus to accomplish the goals and purpose of the game. The game may be played indoors or outdoors, in addition to the game apparatus of this invention the only thing needed are one or more resilient balls, such as the well known super ball and a wall or two. The game apparatus, whose appearance resembles a floor lamp with an inverted shade having holes around the mid-circumference, is placed near a wall or in the corner of two walls. The ball is bounced off the floor to the wall or walls and into the hole. The players have the option of deciding the points awarded for each hole but it would seem that a ball bouncing off the floor and two walls would score higher then a ball off one wall or a ball off the floor only. To add interest to the game, the panel containing the holes should be higher than the average persons height or about seven feet. Since the average ceiling is about eight feet in height a high degree of skill is required to score and most games will have relatively low scores.

It is therefore an object of the invention to provide a new and improved ball toss game apparatus.

It is another object of the invention to provide a new and improved ball toss game.

It is a further object of the invention to provide a new and improved ball toss game that has few rules and is easy to understand.

It is still another object of the invention to provide a new and improved ball toss game that requires a high degree of manual skill and dexterity to accomplish.

It is another object of the invention to provide a new and improved ball toss game apparatus which is of a durable and reliable construction.

It is another object of the invention to provide a new and improved ball toss game apparatus which may be easily and efficiently manufactured and marketed.

These and other advantages, features and objects of the invention will become more apparent from the following description taken in connection with the illustrative embodiment in the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE DRAWING

Figure 1:
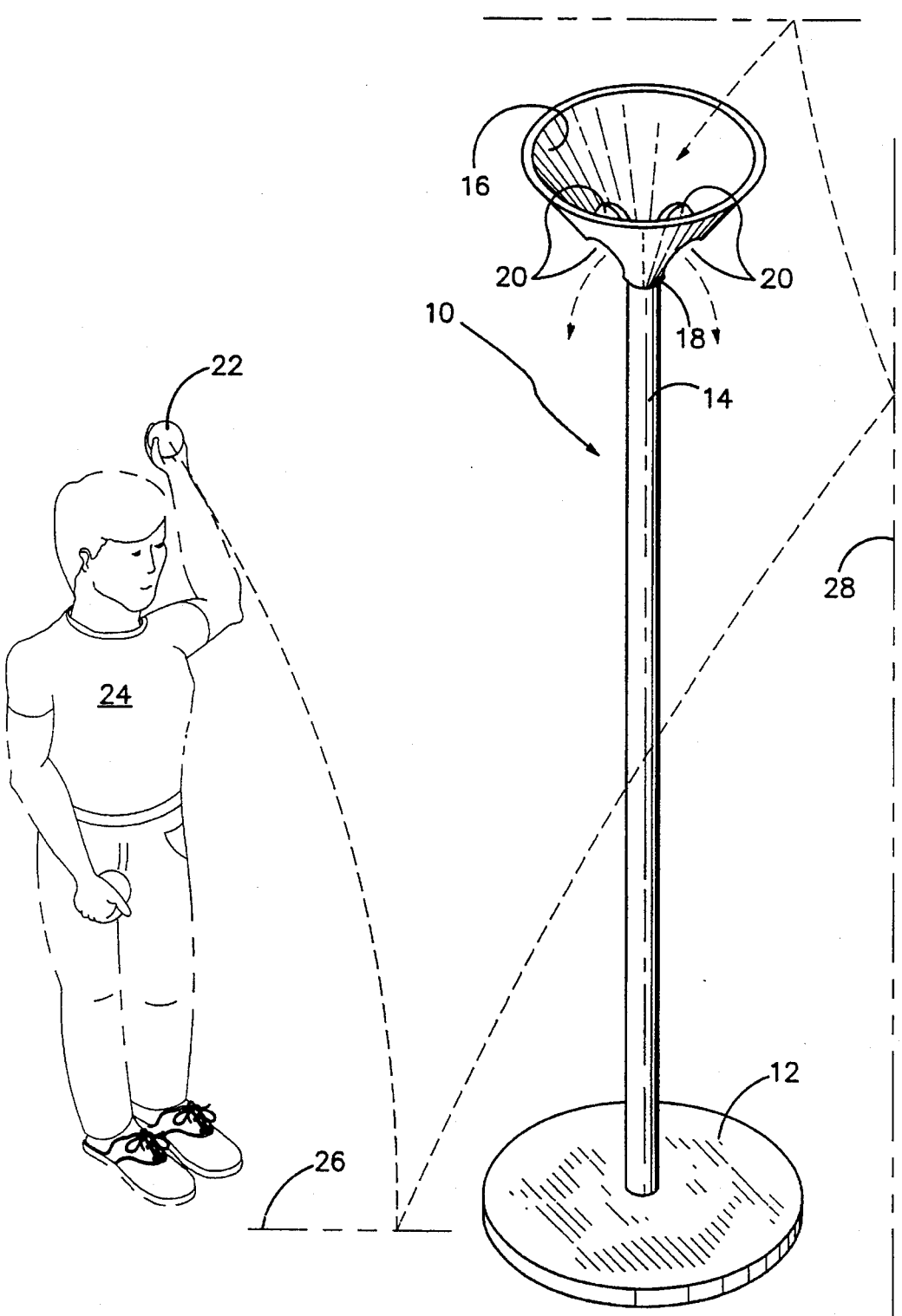
FIG. 1 is an environmental view of the invention.
Figure 2:
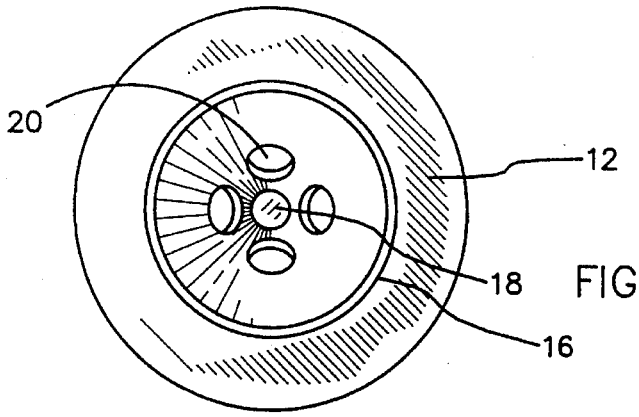
FIG. 2 is a side elevation of the invention.
Figure 3:
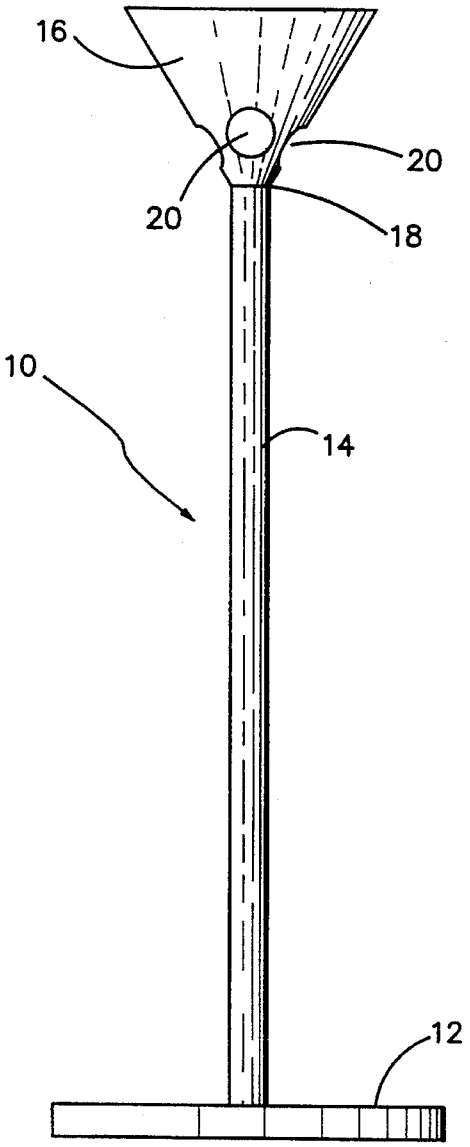
FIG. 3 is a top plan view of the invention.

Referring now to FIGS. 1,2 and 3, the invention is shown generally at 10 and is comprised of a circular base 12 adapted to sit on the floor or ground. A pole 14 is secured to the center of the base and extends vertically above average head height to approximately seven feet, although it should be understood that the length of the pole is more dependent upon the height of the players than any other design feature. Atop the pole is a panel 16 formed in a frusto-conical shape where the pole 14 engages the panel at it's lesser diameter 18, leaving the panel to slope up and away from the pole to it's greater diameter. Apertures 20 in the panel are located in each quadrant of the panel's surface and have a diameter larger than the game ball 22. The top plane formed by the panel's upper edge is open to receive the played ball which is free to fall back to the floor after it passes through one of the apertures 20.

The apparatus may be constructed from any convenient material including metal, plastic or card board.

The game is played by the player 24 bouncing the ball off the floor 26 and the wall 28 and into the top aperture. The value in points of the ball exiting a particular aperture is decided upon by the players before that game begins. Usually each player is given two balls for each turn although local rules could dictate a different procedure. The game is readily adaptable to alternative rules such as placing the apparatus in a corner of a room and giving additional points for bouncing the ball off the floor and two walls before entering the top, or the floor, two walls and the ceiling before entering the open top.

The game apparatus is capable of numerous ball tossing games without changing the spirit and intent of the device herein described.

It should be understood, of course, that the foregoing disclosure relates to only a preferred embodiment of the invention and that numerous modifications of alterations may be made therein without departing from the spirit and scope of the invention as set forth in the appended claims.

What is claimed is:

1. A ball toss game for two or more players comprising: a game apparatus including a base adapted to sit on a horizontal surface; a pole having one end mounted centrally in the base and extending vertically therefrom; a frusto-conically shaped panel mounted over the other end of said pole where the panel engages the pole at it's lesser diameter and slopes toward the base and away from the pole to it's greater diameter, ball receiving apertures in said panel so spaced as to have one aperture in each quadrant around the surface of the panel; and at least two resilient game balls having a diameter less than the diameter of the ball receiving apertures.

* * * * *